US005501148A

United States Patent [19]

Bellio et al.

[11] Patent Number: 5,501,148

[45] Date of Patent: Mar. 26, 1996

[54] AUTOMATIC SHEET PRINTING AND ALIGNMENT SYSTEM

[75] Inventors: Stephen L. Bellio, Newton; Mark J. Condon, Brighton; James F. Mueller, N. Reading, all of Mass.

[73] Assignee: The Charles Stark Draper Laboratory Inc., Cambridge, Mass.

[21] Appl. No.: 306,652

[22] Filed: Sep. 15, 1994

[51] Int. Cl.[6] ..... B41F 13/24

[52] U.S. Cl. ..... 101/232; 101/118; 101/240; 101/115; 270/30; 271/91; 271/93; 271/98; 271/194

[58] Field of Search ..... 101/114, 115, 101/116, 117, 118, 226, 232–242; 271/91, 93, 96, 97, 98, 292, 294, 184, 185, 194, 195, 84, 213, 214, 215, 217; 270/1.1, 30–31, 58–59, 95

[56] References Cited

U.S. PATENT DOCUMENTS

| | | | |
|---|---|---|---|
| 2,212,347 | 8/1940 | Lee | 101/114 |
| 2,612,103 | 9/1952 | D'Amato | 101/118 |
| 3,538,846 | 11/1970 | Jaffa | 101/118 |
| 3,889,595 | 6/1975 | Jaffa | 101/115 |
| 5,024,429 | 6/1991 | Etcheparre et al. | 270/30 |
| 5,046,709 | 9/1991 | Beal | 270/30 |
| 5,288,063 | 2/1994 | Lunt | 270/59 |

FOREIGN PATENT DOCUMENTS

| | | | |
|---|---|---|---|
| 218163 | 8/1957 | Australia | 101/114 |
| 0169477 | 1/1986 | European Pat. Off. | 101/115 |
| 0248752 | 12/1987 | European Pat. Off. | 101/114 |
| 0574760 | 12/1993 | European Pat. Off. | 101/115 |
| 0093552 | 7/1981 | Japan | 101/118 |
| 63350 | 6/1949 | Netherlands | 101/115 |
| 0654454 | 3/1979 | U.S.S.R. | 101/115 |
| 0962007 | 10/1982 | U.S.S.R. | 101/114 |
| 2203992 | 11/1988 | United Kingdom | 101/115 |

*Primary Examiner*—Eugene H. Eickholt
*Attorney, Agent, or Firm*—Iandiorio & Teska

[57] ABSTRACT

An automatic sheet printing and alignment system includes a holding table; a transport system for moving the table through a plurality of stations; a first station for positioning a sheet on the table; a second station for printing features on the sheet positioned on the table; a third station for receiving the printed sheet from its position on the table to compile a stack of sheets with their printed features in predetermined alignment; and a control system for sequentially moving the table through the stations for repeatedly printing and stacking each sheet aligned with prior printed and stacked sheets received, transported and printed by the same table.

11 Claims, 9 Drawing Sheets

AUTOMATIC SHEET PRINTING AND ALIGNMENT SYSTEM

FIELD OF INVENTION

This invention relates to an automatic sheet printing and alignment system.

BACKGROUND OF INVENTION

It is often desirable to print features on a plurality of sheets and then accurately position those sheets relative to one another with respect to those features. Printing is used herein in the very broadest sense to include any kind of marking or depositing. For example, the printing of adhesive in lines on sheets of material to create a honeycomb structure. In that application sheets are printed with parallel spaced lines of glue and then are stacked with the lines of alternate sheets aligned with each other and the intermediate sheets aligned with each other but shifted with respect to the alternate sheet lines. The stack is heated under pressure so the glue adheres. Then the stack is expanded to create the honeycomb structure. One approach to this fabrication technique is to use a rotogravure web press to print the glue lines on the material and then cut the web into sheets. The sheets are positioned by hand using the printed features as references to align the alternate and intermediate lines. One problem with this approach is that the rotogravure process in web form creates tension and tension gradients in the web during the printing process. However, after cutting the web into sheets there is no tension in the sheets. Thus, since the sheets are often elastic the position of the features may vary slightly from sheet to sheet and accurate alignment is difficult. Further, stacking and alignment is difficult to do by eye with high accuracy. And when sheet placement is done by reference to previously placed sheets inaccurate positioning can occur cumulatively.

Another approach to sheeting and stacking pre-printed material is to locate the glue lines and to sheet with respect to those glue lines. Then use the cut edge to align the sheet. A problem with this approach is that the error in adhesive line alignment is the error in locating the glue lines plus the error in aligning the edges.

SUMMARY OF INVENTION

It is therefore an object of this invention to provide a sheet printing and alignment system that operates automatically.

It is a further object of this invention to provide such a sheet printing and alignment system which induces no stress in the sheets.

It is a further object of this invention to provide such a sheet printing and alignment system in which each sheet is mechanically positioned during printing and stacking.

The invention results from the realization that a truly fast and accurate system for printing and stacking sheets can be effected by using the same table to mount a sheet, present it for printing and deliver it to a stack so that the features of each sheet are inherently aligned from sheet to sheet on the stack.

This invention features an automatic sheet printing and alignment system including a holding table for maintaining the position of a sheet on its surface and a transport system for moving the table through a plurality of stations. There is a first station for positioning a sheet on the table, a second station for printing features on the sheet positioned on the table, and a third station for receiving the printed sheet from its position on the table to compile a stack of sheets with their printed features in predetermined alignment. A control system sequentially moves the table through the stations for repeatedly printing and stacking each sheet aligned with prior printed and stacked sheets received, transported and printed by the same table.

In a preferred embodiment the holding table may be a vacuum table and may have two working surfaces, a first surface and a second surface, with a vacuum chamber on each surface. The table may include a reversing mechanism for interchanging the position of the working surfaces and means for maintaining the required vacuum level for keeping the sheet in the same position with respect to a given working surface. The table may receive a sheet on its first working surface which is on top of the table at the first station so that the sheet is printed on on the first working surface which is on the top of the table at the second station, and the reversing mechanism interchanges the positions of the two working surfaces, so that the printed sheet is above the stack. The printed sheet may be deposited onto the stack from the first surface which is on the bottom of the table at the third station. The first station may include a positioning device for placing a sheet on the surface of the vacuum table. The first station may include a cutting mechanism for severing from a web individual sheets to be placed on the table. The second station may include a printing device for printing on the sheet held on the top working surface of the table. The second station may include a printing device for printing on a sheet held on the bottom working surface of the table. The table may receive a sheet on its first working surface which is on the top of the table at the first station. The reversing mechanism may interchange the positions of the two working surfaces so that the sheet is printed on on the first surface of the table which is on the bottom of the table at the second station, and the sheet may be deposited onto the stack from the first surface which is on the bottom of the table at the third station. The third station may include a stacking pallet and an actuator mechanism for drawing the stacking pallet toward the table for receiving the printed sheet from the table and retracting the table thereafter.

DISCLOSURE OF PREFERRED EMBODIMENT

Other objects, features and advantages will occur to those skilled in the art from the following description of a preferred embodiment and the accompanying drawings, in which.

Figure 1A:
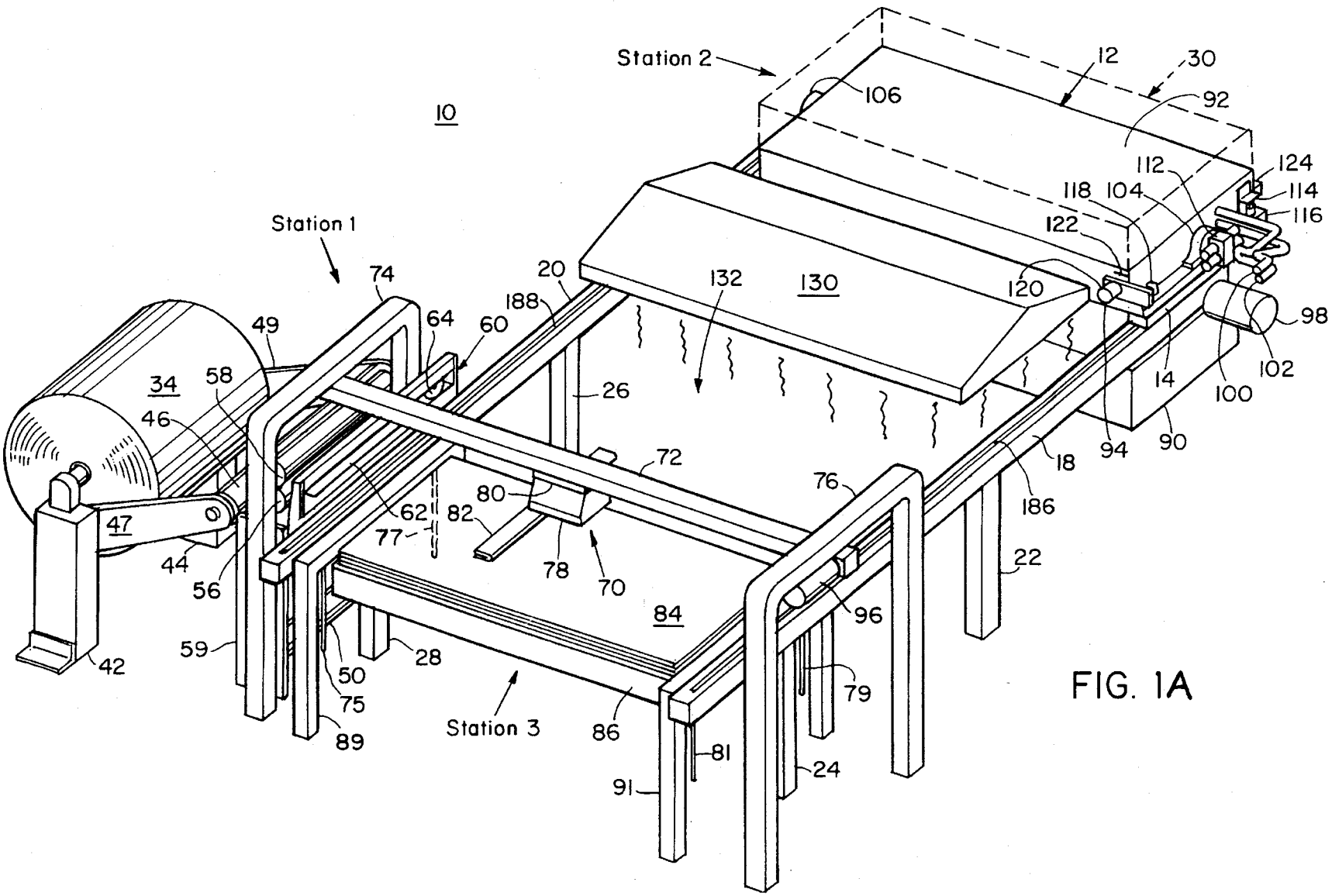
FIG. 1A is a perspective view of an automatic sheet printing and alignment system according to this invention.

This invention may be accomplished with an automatic sheet printing and alignment system that includes a holding table such as a vacuum table and a transport system for moving the table through a plurality of stations. The first station positions a sheet on the table, the second station prints features on the sheet which is positioned on the table, and the third station receives a printed sheet from its position on the table to compile a stack of sheets with their printed features in predetermined alignment. A control system sequentially moves the table through the stations for repeatably printing and stacking each sheet aligned with all prior printed and stacked sheets received, transported and printed by the same table.

In one construction the vacuum table has two working surfaces with a vacuum chamber on each surface. A reversing mechanism enables the table to be rotated, flipped, or in some way moved so that the position of the working surfaces are interchanged: that is, the top surface can be moved to the place of the bottom surface and the bottom surface can be moved to the position of the top surface. With this ability the table receives the sheet on one side, for example on the top, at the first station, and then delivers the sheet, still on top of the table, to the second station where the sheet is printed. After this the table is reversed or flipped so that the printed sheet is now on the bottom of the table. The table is now moved to the third station where it deposits the stack below the table. Alternatively, after being received on the first working surface the sheet can be flipped or reversed so that that working surface with the sheet is on the bottom of the table. The sheet is then printed on from the bottom such as by a roll coater printing technique and then is moved directly to the third station where it is deposited on a stack which is below the table. It is contemplated that it may be desirable to eliminate the reversing step and deposit the sheets on an overhead stack rather than the stack which is beneath the table.

The first station may include a positioning device for placing a sheet on the surface of the vacuum table, for example a gripper mechanism that grabs a sheet from a pile of sheets or draws a length of sheet from a continuous roll or web. A cutting mechanism then severs a sheet of the desired length from the web. As indicated, the printing station may include a printing device such as a screen printer which prints from the top down onto a sheet on the top surface of the table, or may use a roll coater printer which can print upwardly on a sheet held on the bottom surface of the table. The third station may include a stacking pallet and an actuator mechanism which draws the stacking pallet toward the table to receive the printed sheet as it is released from the table and thereafter retracts away from the table. At the point when the sheet is being deposited onto a stack, either above or below the table, the vacuum chamber may be brought to a positive pressure to affirmatively drive the sheet away from the table and onto the stack.

In a preferred embodiment the drying process leaves the adhesive tacky which prevents the stack from shifting during further processing. An alternative approach for preventing stack shift is to tack the adjacently stacked sheets together using a hot iron or other suitable device. These devices could be mounted on robotic actuators for automating the process.

There is shown in FIGS. 1–4 an automatic sheet printing and alignment system 10 according to this invention including a double-sided holding table such as vacuum table 12 movable on carriages 14 and 16 driven along rails 18 and 20. Rail 18 is supported on posts 22 and 24. Rail 20 is supported by posts 26 and 28. The other end of rails 18 and 20 proximate table 12 are supported by the screen print machine, only the screen print head of which is shown in phantom at 30.

Web material 32 is fed from roll 34 rotatable on shaft 36 mounted in bearings 38 and 40 atop posts 42 and 44. Web 32 passes over roll 46 carried on arms 47 and 49 into festooning mechanism 48. Festooning mechanism 48 includes a weighted roller 50 which rides up and down in slot 52 in housing 54 depending upon the amount of slack in web 32. (See also FIG. 16.) This permits a fast action of withdrawal and cutting of sheets from web 32 without having to deal with the inertial control of roll 34 and its changing speed due to its decreasing diameter as it pays out the webbing. From festooning mechanism 48 web 32 moves through a pair of pinch rollers 56 and 58 to cutter mechanism 60. Cutter mechanism 60 includes a guide edge 62 along which moves cutter blade 64. Webbing 32 is drawn through pinch rollers 56 and 58 and cutting mechanism 60 by means of gripper mechanism 70 which is driven back and forth on rail 72 supported by U-shaped frames 74 and 76. Mechanism 70 includes a support structure 78 mounted on carriage 80. Support structure 78 carries gripper mechanism 82 which grips the end of web 32 at cutter mechanism 60 and draws it out across table 12 when it is in position at station 1 over the stack of sheets 84 on pallet 86.

Figure 1B:
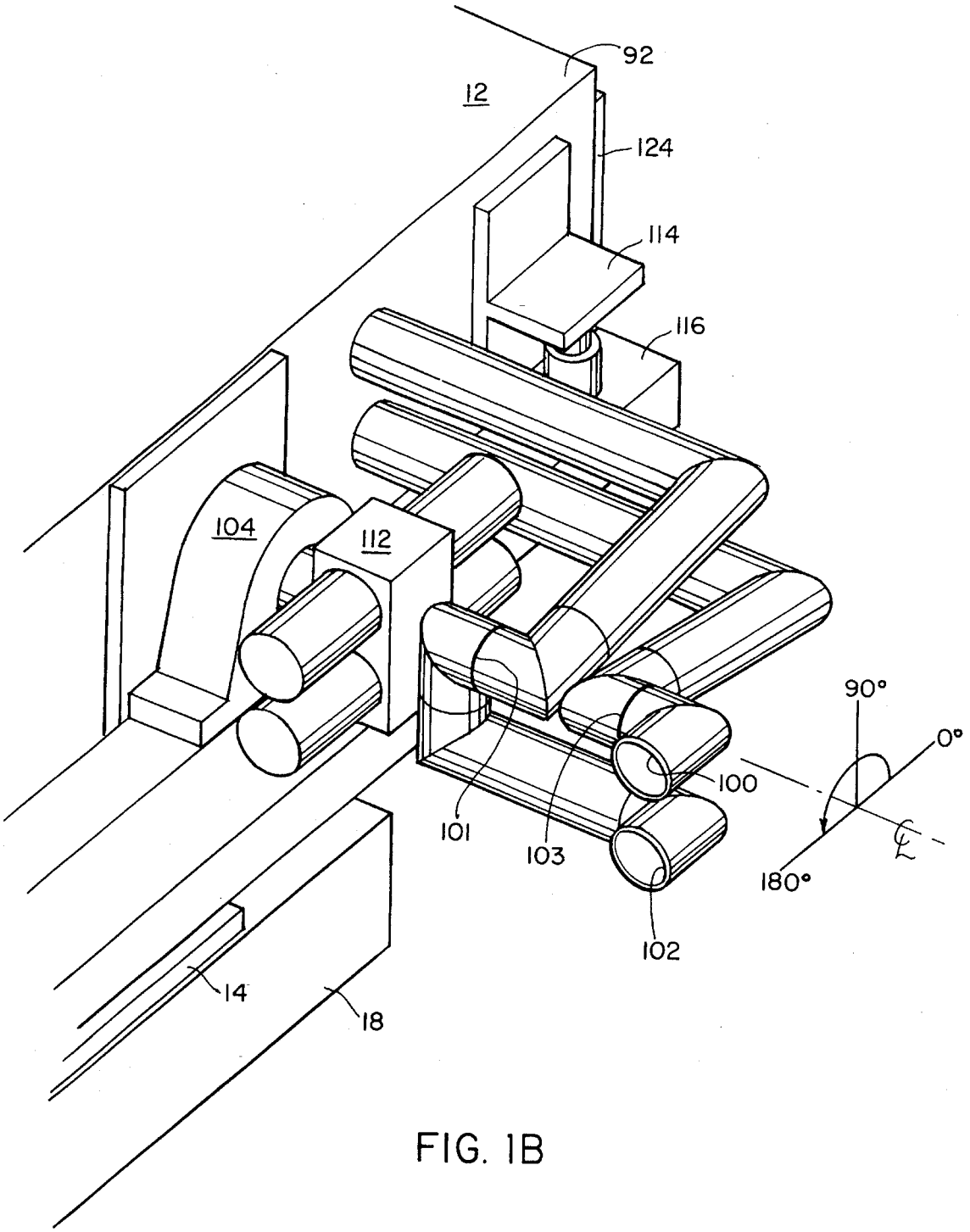
FIG. 1B is an enlarged perspective view of the vacuum tubing for the rotatable vacuum table of FIG. 1A.
Figure 2:
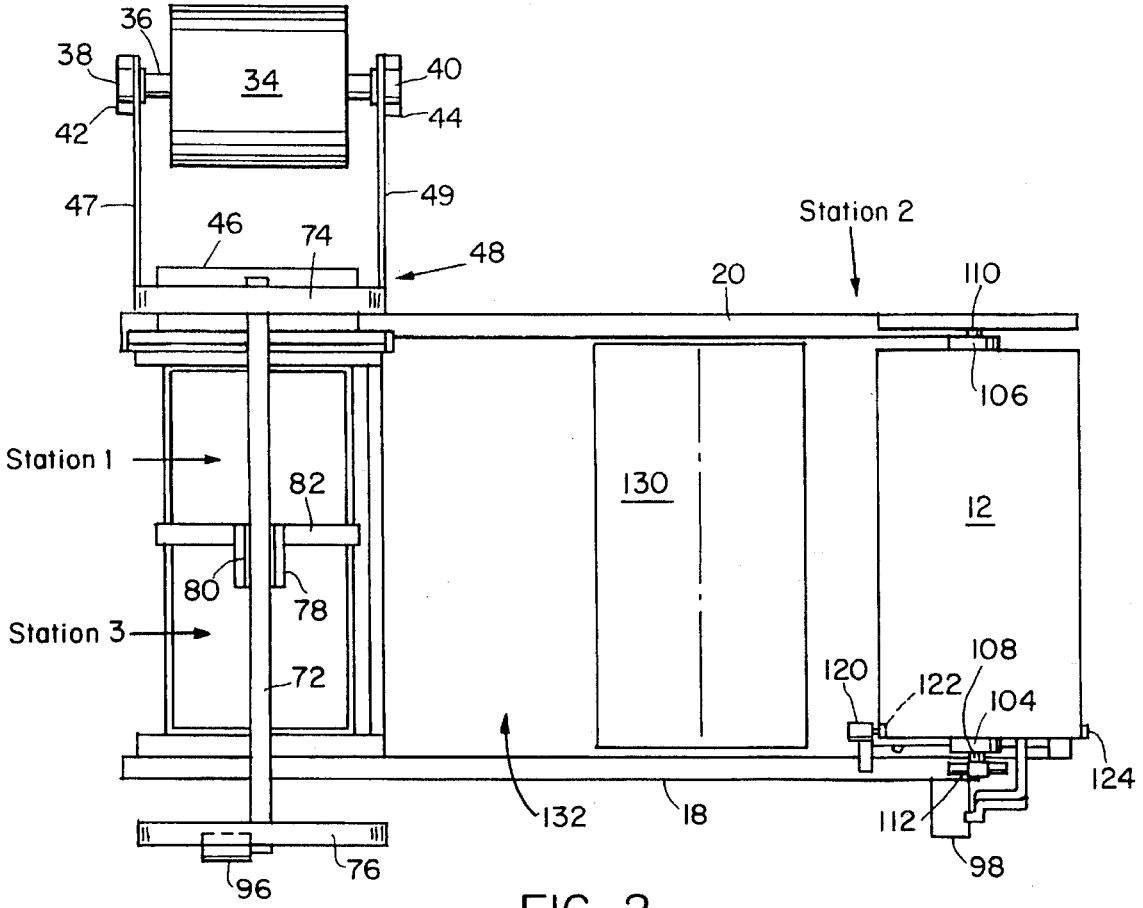
FIG. 2 is a top plan view of the system of FIG. 1A.
Figure 3:
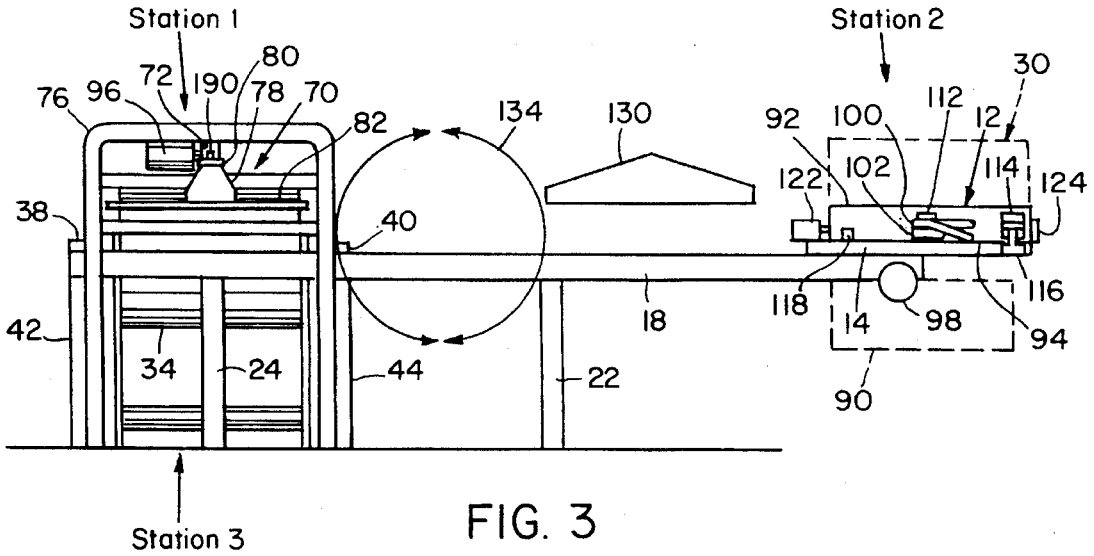
FIG. 3 is a front elevational view of the system of FIG. 2.
Figure 4:
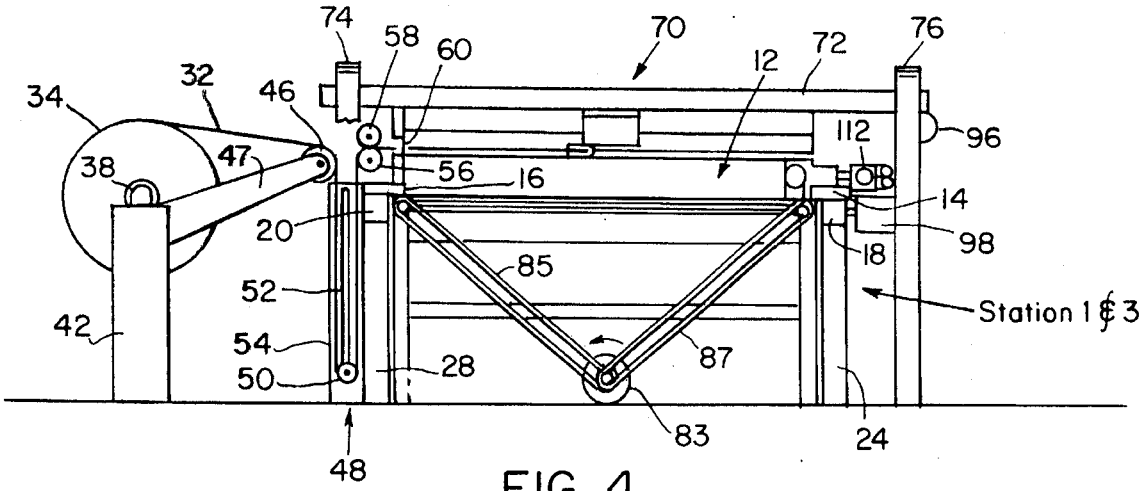
FIG. 4 is a left side elevational view of the system of FIG. 2.

Presently, as shown in the figures, table 12 is at station 2 proximate the screen printing head 30 and/or roll coater 90. Screen print head 30 is preferred when printing on a sheet contained on the top work surface 92 of station 12, while roll coater 90 is preferred when printing on a sheet carried on the lower surface 94 of vacuum table 12. Gripper mechanism 70 is driven to and fro on rail 72 by means of a linear actuator such as manufactured by Star Linear Systems, Raco International, or Hauser. A servo motor 96 senses position and drives the mechanism. A similar mechanism is used in rails 18 and 20 to drive vacuum table 12 using a similar servo motor 98. The two vacuum chambers, one at each work surface 92 and 94 of vacuum table 12, are operated through conduits 100 and 102. Positive pressure as well as negative pressure can be applied to these chambers through conduits 100 and 102. Vacuum table 12 is rotatably supported in pillow block bearings 104 and 106 which receive shafts 108 and 110, respectively. Shaft 108 extends beyond pillow block 104 and engages rack and pinion drive 112 which is used to rotate vacuum table 12 and interchange the position of the two work surfaces so that work surface 92 which is on top as shown, and work surface 94 which is on the bottom as shown, can be flipped so that work surface 94 is on top and work surface 92 is on the bottom. As can be seen in FIG. 1B, conduits 100 and 102 include conventional rotary joints 101 and 103 as used in conventional positive and negative pressure systems, respectively, for maintaining vacuums in both vacuum chambers of vacuum table 12 throughout the table's 180° rotation. Bracket 114 acts as a stop against bumpers 116 and 118 to arrest the movement of work table 12 when it is being rotated to reverse or interchange the position of surfaces 92 and 94. When it is in position a V-shaped centering device 120 self-centers with a complementary notch 122 on either edge 122 or 124 on either edge of table 12 so that it is locked into the correct and repeatable horizontal position. After printing at station 2 table 12 is moved to IR heat source 130 where the adhesive is dried. IR heat source 130 can be any conventional heat source. As table 12 moves from printing station 2 to stacking station 3, the flipping of the table so that its work surfaces are reversed may be accomplished in the area 132 between IR heat source 130 and station 3 as indicated by the circular arrows 134 in FIG. 3.

Alternatively, if instead of a top printing approach such as employs the screen printing head 30 it is desired to use a bottom printing technique such as employs roll coater 90, then the flipping in area 132 can be done on the way from station 1 to station 2. Station 1 and station 3 are actually at the same location. Station 1 involves the operation of gripper mechanism 70 and cutter mechanism 60 which cuts and places the sheet on table 12. Station 3 in the lower portion of that region includes stacking pallet 86 which carries stack 84 on which the printed and dried sheet is deposited. Pallet 86 is vertically adjustable to move stack 84 towards and away from work table 12 at the appropriate times by means of lead screws 75, 77, 79 and 81 driven by servo motor 83 and belts 85 and 87, shown in greater detail in FIG. 15. Lead screws 75, 77, 79 and 81 are supported by flames 89 and 91.

Figure 5:
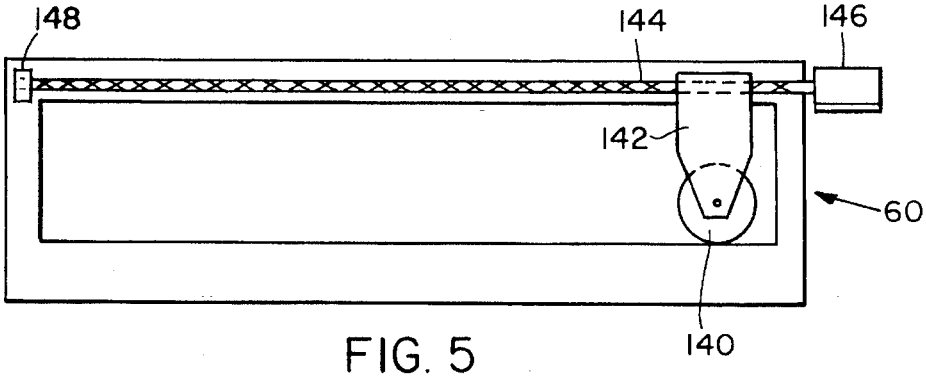
FIG. 5 is an enlarged derailed schematic view of the cutter mechanism from FIG. 3.
Figure 6:
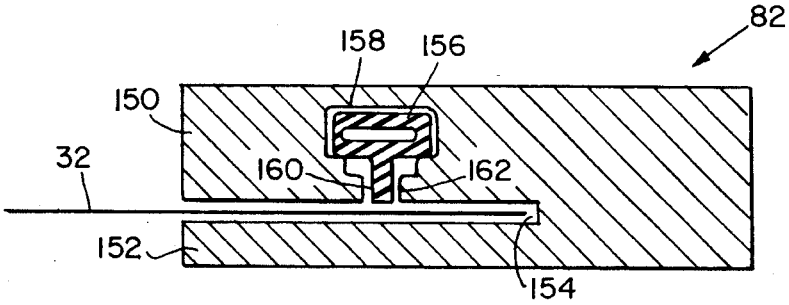
FIG. 6 is an enlarged detailed schematic view of the gripper mechanism from FIG. 4 in the retracted position.
Figure 7:
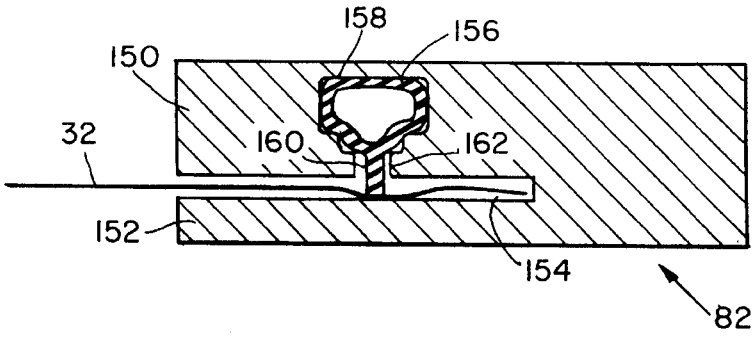
FIG. 7 is a view similar to FIG. 6 with the gripper mechanism in the extended gripping position.
Figure 8:
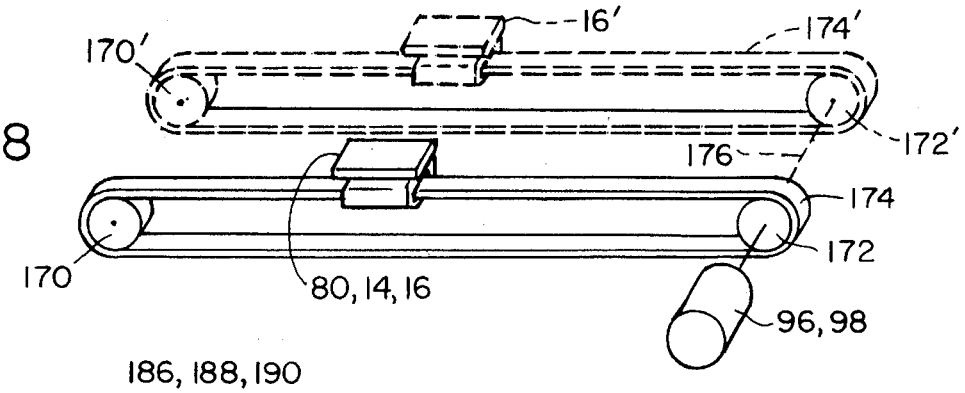
FIG. 8 is an enlarged detailed schematic view of the drive mechanism used to drive the vacuum table and the gripper drive mechanism of FIGS. 1–4.
Figure 9:
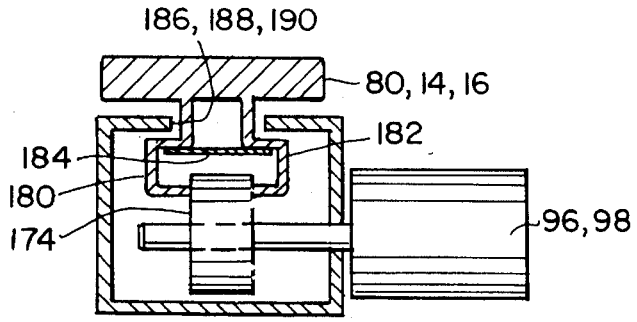
FIG. 9 is a more derailed view of the drive mechanism of FIG. 8.

Cutter mechanism 60, FIG. 5, includes cutter wheel 140 rotatably carried by carriage 142 which is movable on lead screw 144 driven by motor 146. Lead screw 144 is journaled at its distal end in bearing 148. Gripper 82, FIGS. 6 and 7, includes a pair of spaced apart jaws 150, 152, whose interstitial gap 154 receives the end of web 32. A flexible conduit 156 mounted in recess 158 carries a dependent vane 160 which is movable in slot 162. When conduit 156 is pressurized, it expands as shown in FIG. 7, driving vane 160 out through slot 162 whereby it pinches the end of web 32 against lower jaw 152. Then when gripper 82 is moved outwardly along with the rest of the gripper mechanism 70 along rail 72, web 32 is drawn along with it to the proper distance after which cutter mechanism 60 severs it from the remaining portion of web 32 on roll 34 and creates a sheet for further processing. The drive mechanisms in rails 18 and 20 are identical to that in rail 72. They are available from Star Linear Systems, Raco International, or Hauser. Each contains a pair of pulleys 170, 172 which are driven by their respective motors 96, 98, to drive a belt 174 on which is carried a carriage such as carriage 80, 14 or 16. The single motor 98 drives the mechanisms in both rails 18 and 20 by virtue of a drive shaft 176 which mechanically couples between pulley 172 and pulley 172'. Carriage 80, 14 or 16, FIG. 9, is connected by a pair of arms 180, 182 to belt 174. A flexible steel sealing plate 184 is used to at least partially close the slot 186, 188, FIG. 1, in rails 18 and 20, and a similar slot 190, FIG. 3 in rail 72.

Figure 10:
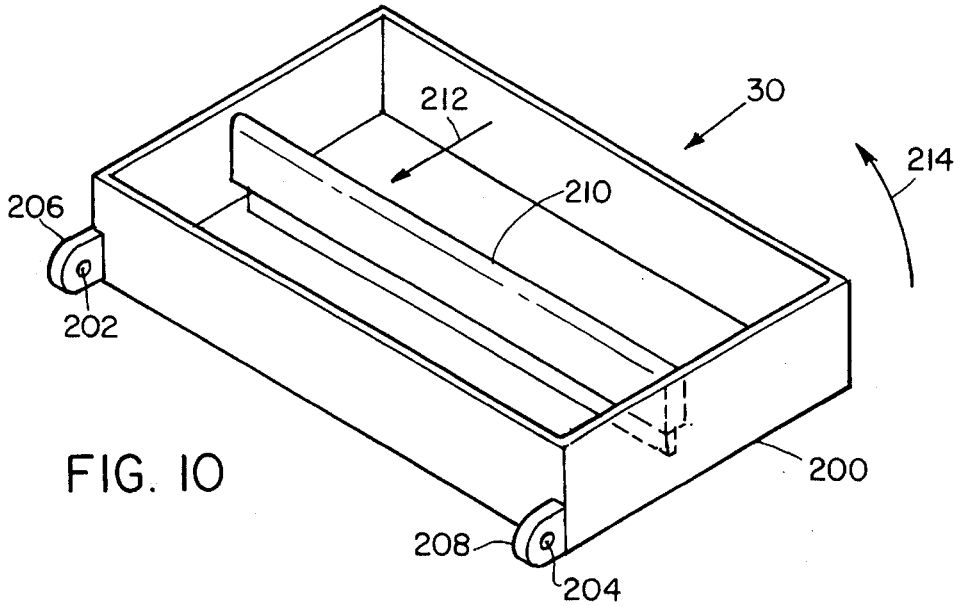
FIG. 10 is an enlarged detailed schematic view of a portion of the screen printer device of FIGS. 1–4.
Figure 11:
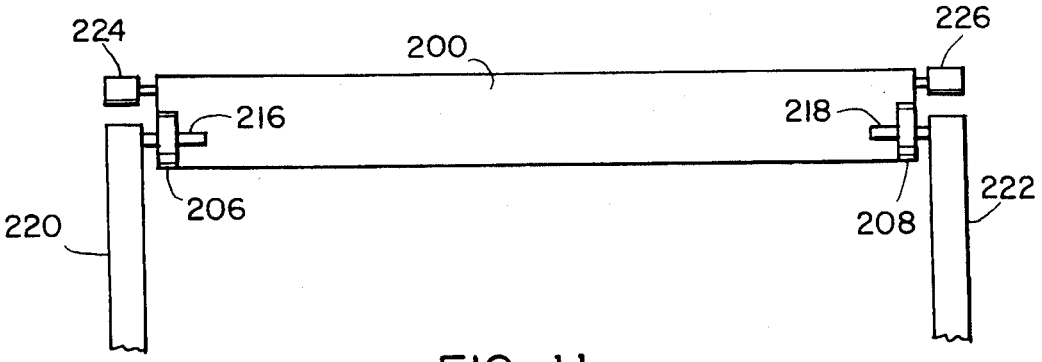
FIG. 11 is a front elevational view showing a portion of the screen printer of FIG. 10 with a mechanism for moving it laterally to shift the pattern application on selected sheets.

Screen printing head 30, FIG. 10, includes a pivotable housing 200 which pivotally mounts on a shaft received in holes 202,204 of tabs 206 and 208. As squeegee 210 is brought back in the direction of arrow 212, housing 200 is urged to move upwardly, as indicated by arrow 214, to peel the screen away from the workpiece. With housing 200, FIG. 11, riding on stub axles 216, 218, supported in posts 220 and 222, housing 200 can be shifted laterally left and right, by air cylinders 224 and 226. In this way the pattern laid down from sheet to sheet can be shifted, so for example the first sheet would have a series of adhesive lines laid down on it parallel to the direction of motion of work table 12 in a first position. In preparation for the second sheet, housing 200 would be shifted to the right the required amount so that the pattern of lines would be deposited on the second sheet in locations midway between the lines laid down on the first sheet. Shifted housing 200 would then cause the third sheet to have the pattern of adhesive lines laid down similar to the first sheet and the shift back in the other direction would cause the fourth sheet to have its lines laid down aligned with the second sheet, and so on. In this way the staggered pattern of adhesive can be created in a stack for the fabrication of honeycomb materials.

Figure 12:
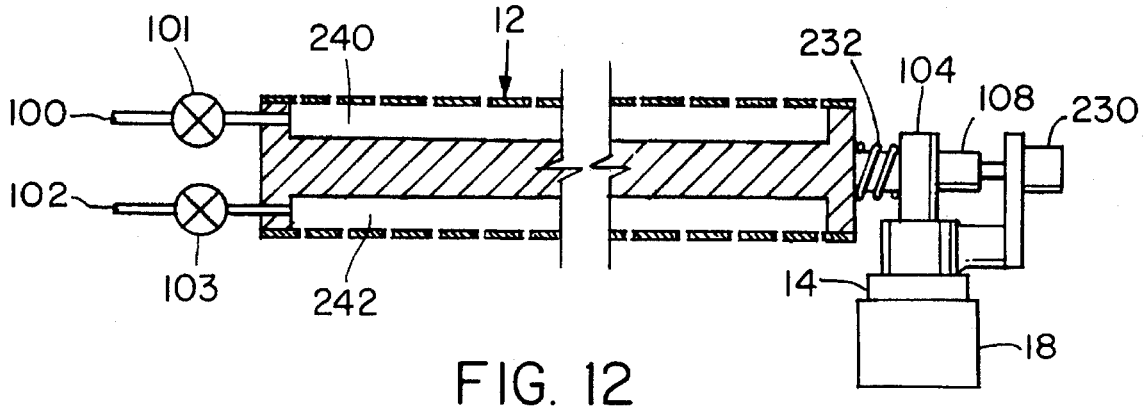
FIG. 12 is an enlarged detailed view of a portion of an alternative mechanism for shifting the application of the pattern to a sheet.
Figure 13:
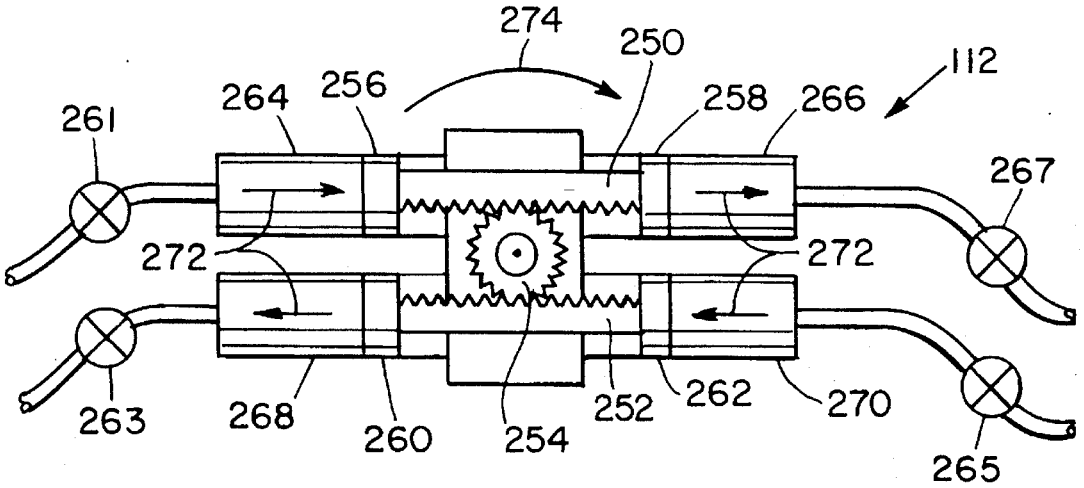
FIG. 13 is an enlarged detailed schematic view of the table reversing mechanism of FIGS. 1–4.
Figure 14:
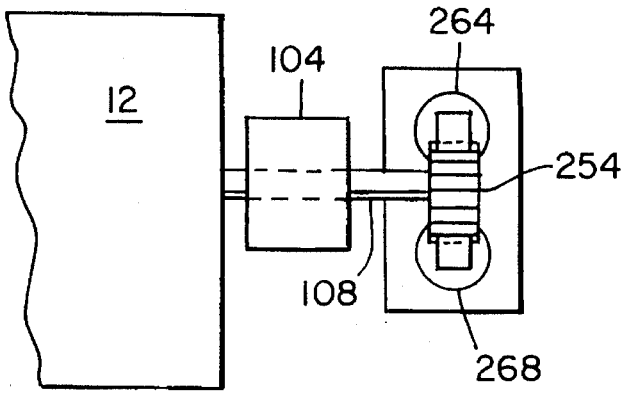
FIG. 14 is a side elevational view of the mechanism of FIG. 13.

Alternatively, the entire vacuum table 12, FIG. 12, could be shifted by using air cylinder 230 to overcome the force of spring 232 in order to create the staggered line pattern. The vacuum chambers 240 and 242 are also seen in detail in FIG. 12 where they are serviced by conduits 100 and 102, through valves 101,103, respectively, which can pressurize them negatively or positively. Reversing mechanism 112, FIG. 13, includes two racks 250 and 252, which engaged with pinion 254. Rack 250 has a piston 256, 258 at either end. Rack 252 has similar pistons 260, 262, at either end. Companion air cylinders 264, 266 and 268, 270 are operated through valves 261,263, 265, 267, to drive racks 250 and 252 in opposite directions in order to reverse or interchange the work surfaces of vacuum table 12. For example, as shown in FIGS. 13 and 14, electronic valves 264, 268 can be operated to rotate pinion 254, and thus work table 12, in the clockwise direction as indicated by arrow 274.

Figure 15:
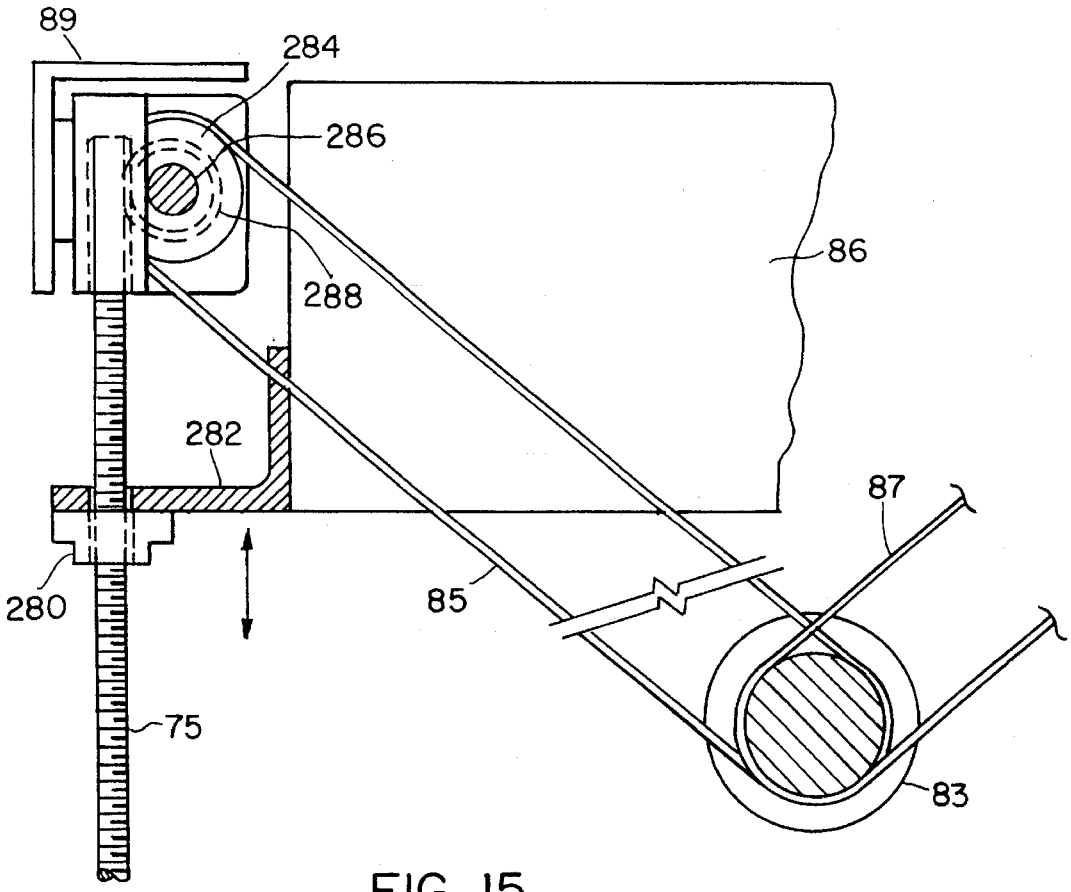
FIG. 15 is an enlarged detailed schematic view of the stacking mechanism of FIGS. 1–4.

The stacker pallet and the mechanism which moves it vertically are shown in more detail in FIG. 15, where pallet 86 is shown to include four follower nuts 280 which engage with each of lead screws 75, 77, 79 and 81. Nut 280 is fixed by bracket 282 to pallet 86. Belt 85, driven by motor 83, in turn drives pulley 284 which drives shaft 286. Shaft 286 includes two gears 288, one engaged with each of lead screws 75 and 77 and interconnected by shaft 286. Lead screws 79 and 81 are similarly driven through a like arrangement of pulleys, shafts and gears by belt 87 which, like belt 85, is driven by a pulley in turn driven by servo motor 83. The system is mechanically synchronized. The entire system is operated through a conventional computer controller such as an IBM PC.

Figure 16:
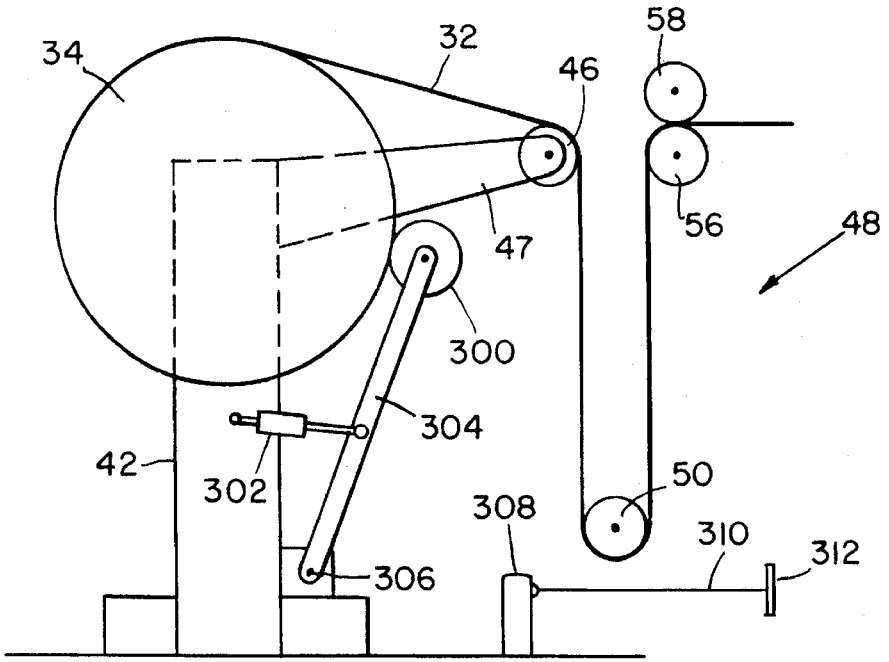
FIG. 16 is an enlarged detailed view of the roll unwind and festooning mechanism of FIGS. 1–4.

The feeding mechanism and festooning mechanism 48 are shown in greater detail in FIG. 16, where the unwind motor 300 is brought to bear against roll 34 by the action of air cylinder 302 acting on lever arm 304 pivoted at 306. Unwind sensor 308 provides a light beam 310 that is reflected off retro-reflector 312 to indicate the level of cylinder or roller 50 and festooning mechanism 48. When roller 50 is low enough to interrupt beam 310, the unwind motor 300 is stopped so that the feeding of web 32 is ceased. When web 32 has been drawn for cutting and depositing on work table 12, roller 50 will rise, beam 310 will be reestablished, and motor 300 will be activated to cause roll 30 to rotate and feed more web 32.

Figure 17:
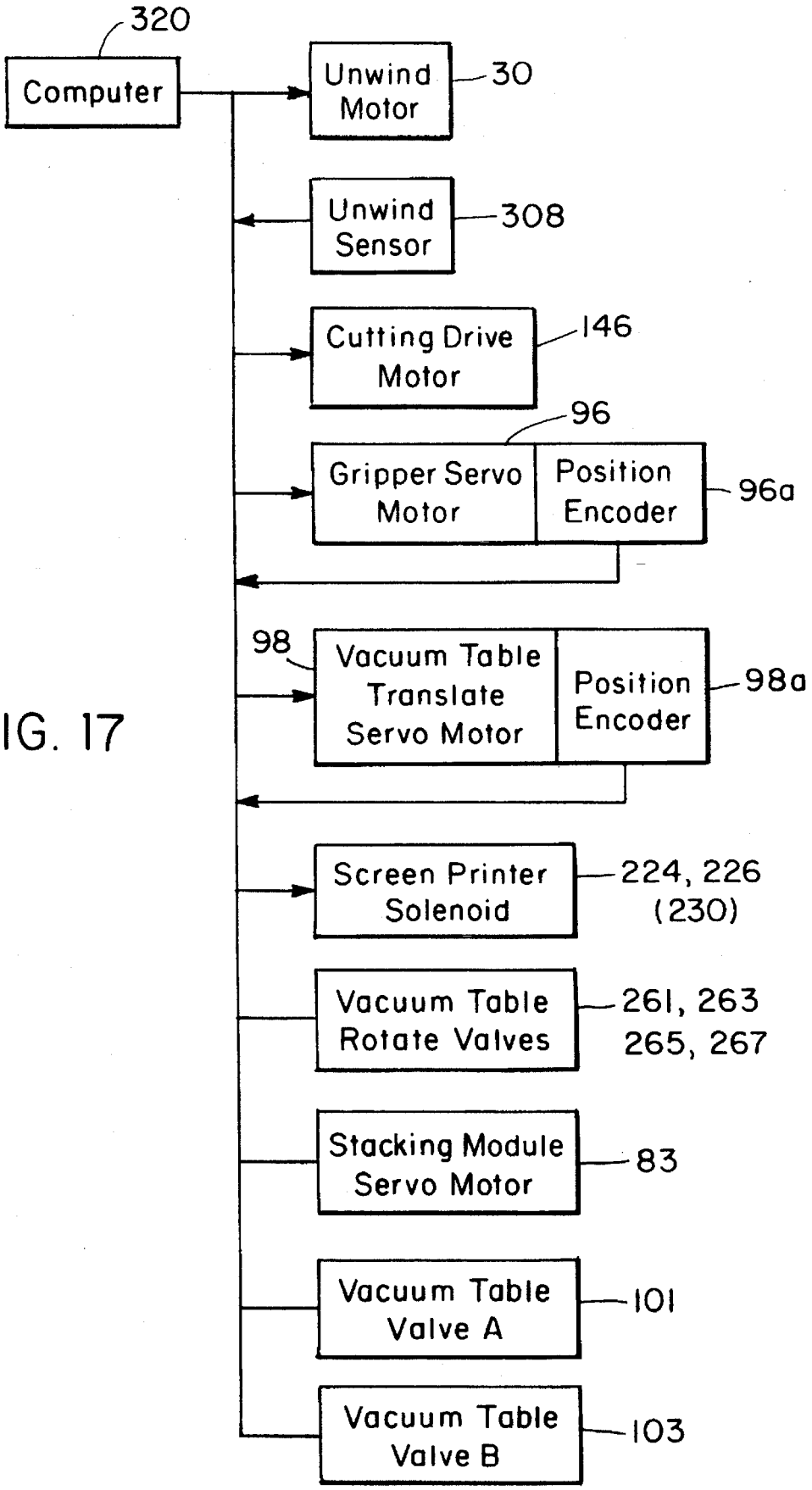
FIG. 17 is a schematic block diagram showing the control system driven by a computer for operating the system of FIGS. 1–4.

The entire system is operated under control of a computer controller such as an IBM PC 320, FIG. 17, which sequences the operation of unwind motor 300 in conjunction with feedback from unwind sensor 308. It also operates cutting drive motor 146 and gripper servo motor 96 which includes its own position encoder 96*a* that feeds back position information to computer 320. Computer 320 also operates vacuum table translate servo motor 98, which includes its own position encoder 98*a* that feeds back information to computer 320. Computer 320 also operates screen printer solenoids 224 and 226, or alternatively, solenoid 230 which operates shifts vacuum table 12. Vacuum table rotate valves 261, 263, 265 and 267 are also operated by computer 320 to selectively drive racks 250 and 252. Computer 320 also operates stacking module servo motor 83 as well as vacuum table valves 101 and 103 and screen printing head 30.

Figure 18:
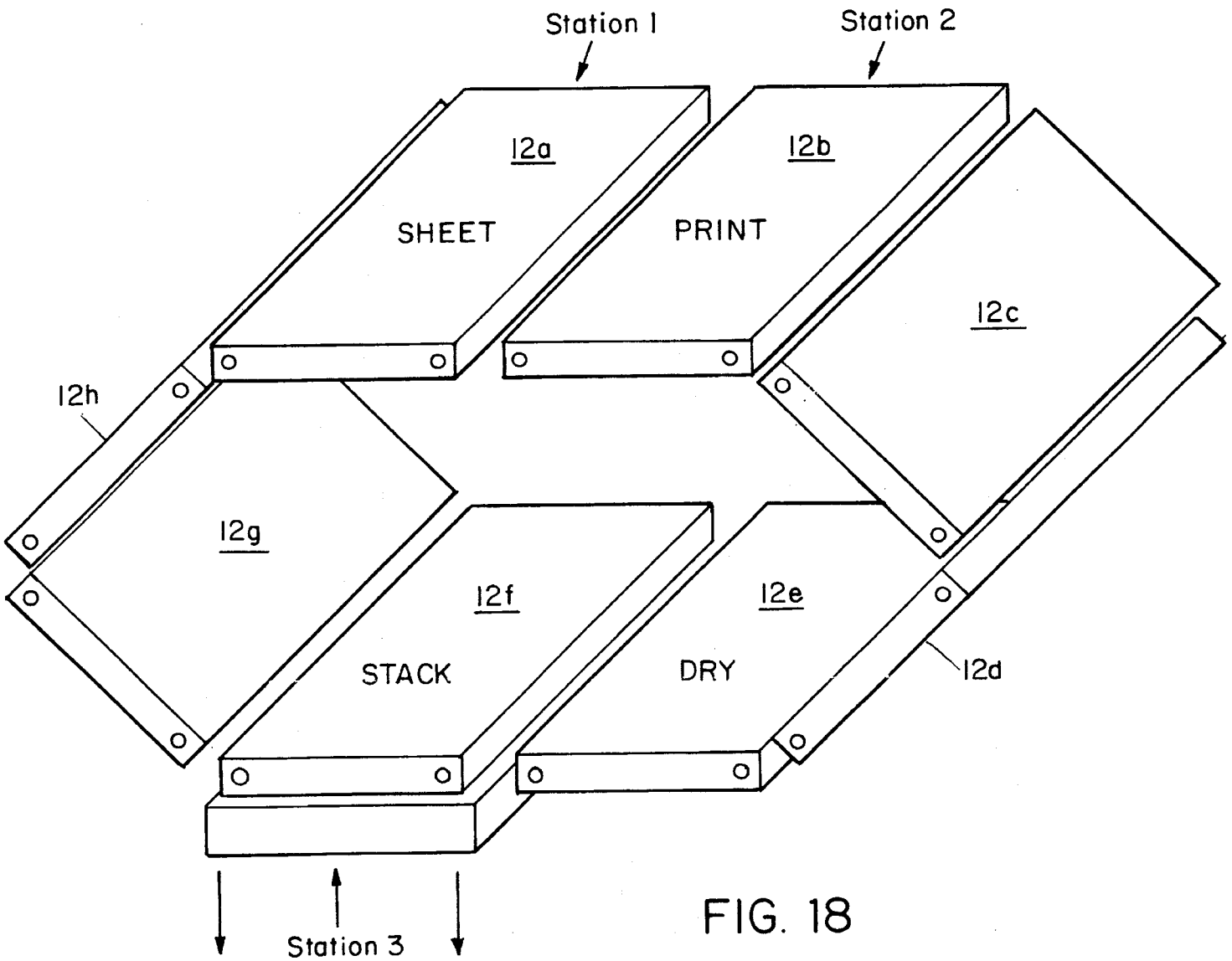
FIG. 18 is a schematic illustration of an alternative construction of an automatic sheet printing and alignment system according to this invention.

Although in the embodiment shown the stations are folded over so that stations 1 and 3 are located generally in the same area and the work table shuttles back and forth between them and station 2, this is not a necessary limitation of the invention, as any suitable configuration can be used. For example, as shown in FIG. 18, a continuous system can be used wherein the work table 12 moves through a circular path where there can be a plurality of work tables 12*a*, 12*b*, 12*c*, 12*d*, 12*e*, 12*f*, 12*g* and 12*h*. The sheet is deposited on top of table 12*a* in station 1, while another sheet is being printed on on table 12*b* at station 2. Table 12*c*, bearing its printed sheet, is moving to the position of table 12*d* while table 12*d* is moving to the position of table 12*e*, which is a drying station for example, subject to an infrared heating source. Meanwhile table 12*f* is momentarily resting over the stack where it can release and drop its completed sheet, and empty table 12*g* and table 12*h* are moving back toward station 1, where they will accept a new sheet.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. An automatic sheet printing and alignment system, comprising:

a holding table for maintaining the position of a sheet on its surface;

a transport system for moving said table through a plurality of stations;

a first station for positioning a sheet on said table;

a second station for printing features on said sheet positioned on said table;

a third station for receiving said printed sheet from its position on said table to compile a stack of said sheets with their printed features in predetermined alignment; and a control system for sequentially moving said table through said stations for repeatably printing and stacking each said sheet aligned with prior printed and stacked sheets received, transported and printed by the same said table.

2. The automatic sheet printing and alignment system of claim 1 in which said table is a vacuum table.

3. The automatic sheet printing and alignment system of claim 1 in which said table has two working surfaces, a first surface and a second surface, with a vacuum chamber on each surface.

4. The automatic sheet printing and alignment system of claim 3 in which said table includes a reversing mechanism for interchanging the position of said working surfaces and means for maintaining the required vacuum level for keeping the sheet in the same position with respect to a given working surface.

5. The automatic sheet printing and alignment system of claim 4 in which said table receives said sheet on its said first working surface which is on top of said table at said first station and said sheet is printed on said first working surface which is on top of said table and said second station and said reversing mechanism interchanges the positions of said two working surfaces so that the printed said sheet is deposited onto said stack from the said first surface which is on the bottom of said table at said third station.

6. The automatic sheet printing and alignment system of claim 1 in which said first station includes a positioning device for placing a sheet on a surface of said table.

7. The automatic sheet printing and alignment system of claim 1 in which said first station includes a cutting mechanism for severing from a web individual sheets to be placed on said table.

8. The automatic sheet printing and alignment system of claim 3 in which said second station includes a printing device for printing on said sheet held in a top said working surface of said table.

9. The automatic sheet printing and alignment system of claim 3 in which said second station includes a printing device for printing on said sheet held in a bottom said working surface of said table.

10. The automatic sheet printing and alignment system of claim 4 in which said second station receives said sheet on its said first working surface which is on top of said table at said first section, said reversing mechanism interchanges the positions of said two working surfaces so that said sheet is printed on on said first surface of said table which is on the bottom of said table at said second station and said sheet is deposited onto said stack from said first surface which is on the bottom of said table at said third station.

11. The automatic sheet printing and alignment system of claim 1 in which said third station includes a stacking pallet and an actuator mechanism for drawing said stacking pallet toward said table for receiving said printed sheet from said table, pressurizing said table, and retracting said pallet thereafter.

* * * * *